United States Patent [19]

Annovi

[11] 4,190,970

[45] Mar. 4, 1980

[54] LEVER CLOSURE FOR SKI BOOTS

[75] Inventor: Giuseppe Annovi, Montebelluna, Italy

[73] Assignee: Calzaturificio Giuseppe Garbuio S.A.S., Treviso, Italy

[21] Appl. No.: 915,150

[22] Filed: Jun. 13, 1978

[30] Foreign Application Priority Data

Jun. 13, 1977 [IT] Italy ..... 84134 A/77

[51] Int. Cl.[2] ..... A43B 11/00; A43B 5/04; A43C 11/00

[52] U.S. Cl. ..... 36/50; 36/117; 24/70 SK

[58] Field of Search ..... 36/50, 117–121; 24/68 SK, 69 R, 69 SK, 70 SK, 70 R, 71 ST

[56] References Cited

U.S. PATENT DOCUMENTS

| | | | |
|---|---|---|---|
| 2,199,444 | 5/1940 | Rauglas | 24/70 SK |
| 3,408,754 | 11/1968 | Kueter | 36/117 |
| 3,561,139 | 2/1971 | Stillman | 36/119 |
| 4,083,129 | 4/1978 | Collombin et al. | 36/117 |
| 4,085,528 | 4/1978 | Delery | 36/121 |

FOREIGN PATENT DOCUMENTS

| | | | |
|---|---|---|---|
| 2414439 | 10/1975 | Fed. Rep. of Germany | 36/117 |
| 2712001 | 9/1977 | Fed. Rep. of Germany | 36/119 |

*Primary Examiner*—James Kee Chi
*Attorney, Agent, or Firm*—D. Paul Weaver

[57] ABSTRACT

A closure lever on the rear of a ski boot is engaged with a cable which passes beneath side lugs near the elevation of the sole of the boot and forwardly of the heel. The cable ends carry connectors which engage through apertures formed in the ends of a tension strap which passes transversely over the instep. In an alternative arrangement, the cable may be crossed beneath the sole of the boot and engaged within crossing grooves in the sole.

10 Claims, 4 Drawing Figures

LEVER CLOSURE FOR SKI BOOTS

BACKGROUND OF THE INVENTION

Level closures for ski boots are well known in the art, and such closures customarily consist of a lever attached directly to one side of a vamp and a coacting loop attached directly to the opposite side of the vamp for selective engagement with teeth of the lever.

Ski boot closures are also known comprising a lever attached to one vamp side, and provided with a loop which engages an element projecting outwardly from the opposite vamp side.

A common feature of the prior art lever closures is the placement of the lever at the front of the boot to exert a drawing action on a rigid or flexible loop which forms the connecting element between the sides of the vamp. When the connecting element is tensioned by lever action, the two sides of the vamp are drawn together to close the boot. In practice, in the prior art, several closing levers and coacting loops are provided on the front of the boot.

A serious disadvantage of the above-noted prior art lever closures is that the levers, due to their frontal positions, may snag on slalom pickets or on other projections existing along the descent track. Moreover, the frontal levers may injure the skier or other skiers in case of a fall or accidental crash.

A further disadvantage inherent in front mounted closure levers is that the draw action of the lever on the closure loop is localized, affecting only a limited area of the vamp, with a consequent uneven distribution of tensions, which is not satisfactory in terms of modern-day requirements.

This invention seeks to overcome all of these prior art deficiencies in ski boot lever closures by placing a draw lever at the rear of the ski boot leg portion for cooperation with a flexible element such as a cable whose ends are attached to a tension strap extending transversely across the top of the instep. The cable may engage side lugs on the boot located between the lever and tension strap near the elevation of the sole, or alternatively the cable may be crossed beneath the sole in this region. In either case, shifting of the lever to the boot closing position draws the tension strap tightly down on the instep portion of the boot to effect a very secure closing of the vamp with an even distribution of tension forces.

Additional features of the invention will become apparent during the course of the following description.

DETAILED DESCRIPTION

Figures 1, 2:
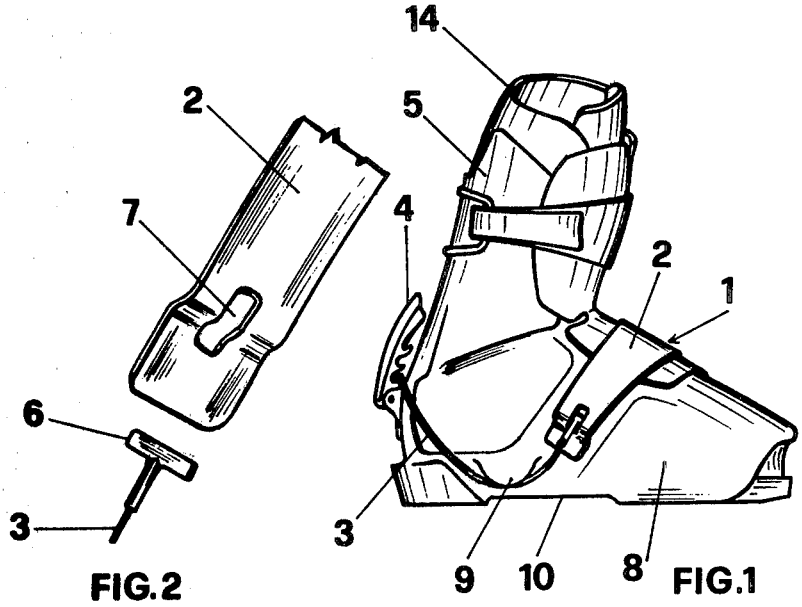
FIG. 1 is a side elevation of a ski boot equipped with a lever closure embodying the invention.
FIG. 2 is an enlarged fragmentary exploded perspective view of the closure.

Referring to the drawings in detail, wherein like numerals designate like parts, a ski boot closure embodying the invention comprises in FIG. 1 a transverse tension strap 1 including a strip 2 which extends over the instep and is formed of metallic or synthetic material. At its opposite ends, the tension strap is connected in a manner to be described with a flexible or semi-rigid cable 3, also formed of metallic or synthetic material, and adapted to engage with a pivoted vertically swingable closure lever 4 mounted on the rear side of the ski boot leg portion 5 of the boot somewhat above the heel.

Advantageously, the two ends of the thin cable 3 are provided with T-shaped connecting elements 6 adapted for quick engagement and disengagement with apertures 7, provided in the opposite end portions of the transverse tension strap 2. The arrangement provides for easy replacement in the event of breakage of the cable.

In the embodiment of FIG. 1, the boot 8 is provided on each side with lugs 9 disposed close to the sole 10 and between the ends of the tension strap 2 and rear closure lever 4. The lugs 9 are grooved on their bottoms to engage and produce bending of the cable 3. The lugs 9 are preferably formed of synthetic material and may be integral with the boot 8.

In operation, when the cable 3 is properly engaged with the lever 4, the skier may easily place the foot in the boot. To close the boot, the lever 4 is swung toward the upright closing position shown in the drawing thus exerting a strong tensioning action through the cable 3 on the tension strap 2 which spans the instep. The two side lugs 9 cause the strong tension forces to be applied longitudinally through the strap 2 and transversely across the top of the boot in the instep region, thus producing secure closing of the two vamp sides and locking of the foot in the boot.

The invention above-described offers numerous advantages including:

(1) The placing of the lever 4 at the rear of the boot prevents the lever from snagging in obstacles on the descent track and prevents the lever from injuring skiers or others in a fall or crash.

(2) A very even distribution of tension forces is achieved in the boot closure in contrast to the traditional arrangement of levers on the front of the boot.

(3) An advantageous effect is achieved tending to push the skier's heel toward the sole of the boot, due to the action of the rear closure lever situated above the heel.

(4) It is possible to adjust the angle of inclination of the leg portion of the boot by varying the tension on the cable. The skier may thus, when the lever is slackened, walk freely without annoying pressure from the "spoiler" 14 on the leg.

Figures 3, 4:
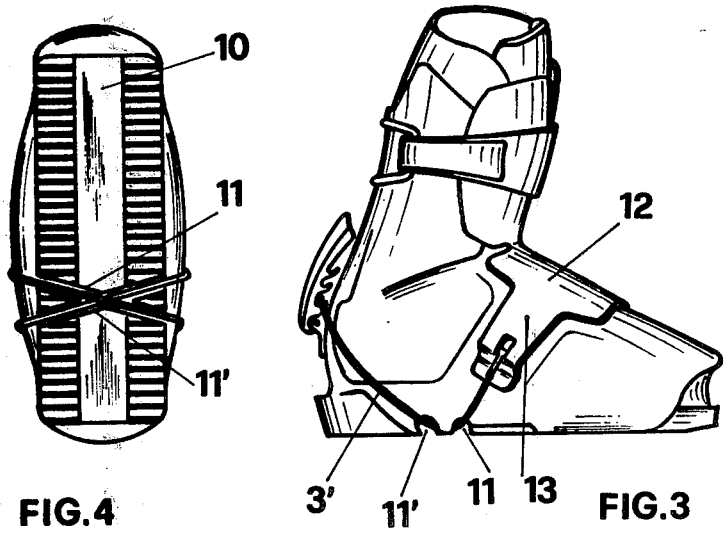
FIG. 3 is a side elevation, similar to FIG. 1, showing a modification.
FIG. 4 is a bottom plan view of the invention as shown in FIG. 3.

In the modification of FIGS. 3 and 4, the lugs 9 are omitted and the cable 3' is not bent aside as in FIG. 1 by lugs. Instead, the cable 3' passes beneath the sole of the boot engaging through crossed grooves 11 and 11' formed at two different levels on the surface of the sole 10. Additionally, the tension strap 12 in FIG. 3 has extensions 13 which engage directly with the ends of cable 3' in the manner already described.

It is to be understood that the forms of the invention herewith shown and described are to be taken as preferred examples of the same, and that various changes in the shape, size and arrangement of parts may be resorted to, without departing from the spirit of the invention or scope of the subjoined claims.

I claim:

1. A lever closure for ski boots comprising a transverse tension strap laying across the front portion of the boot forwardly of the leg, a closure lever mounted on the rear of the boot, and an element interconnecting opposite ends of the tension strap with said closure lever, said element being engaged with the boot between the lever and said tension strap in such a manner that tension forces transmitted through said element are directed to the tension strap longitudinally thereof and downwardly.

2. A lever closure for ski boots as defined in claim 1, and a pair of opposite side lugs on the ski boot near the elevation of the sole and positioned between the ends of the tension strap and said closure lever, and opposite side portions of said element engaging said lugs and being bent in the regions of the lugs.

3. A lever closure for ski boots as defined in claim 2, and said element being a cable and engaging the bottoms of said lugs, the lugs being grooved on their bottoms to seat the cable.

4. A lever closure for ski boots as defined in claim 3, and a quick release connection between at least one end of the cable and one end of the tension strap.

5. A lever closure for ski boots as defined in claim 4, and said connection including a T-connector on the cable and an aperture in the tension strap.

6. A lever closure for ski boots as defined in claim 1, and said element extending beneath the sole of the boot and transversely of the sole in the region between the tension strap and said closure lever.

7. A lever closure for ski boots as defined in claim 6, and said element being a cable and having portions which cross each other beneath the sole of the boot.

8. A lever closure for ski boots as defined in claim 7, and said sole being grooved to seat the crossing portions of said cable.

9. A lever closure for ski boots as defined in claim 8, and quick release fastener means interconnecting the ends of the cable with end portions of said tension strap.

10. A lever closure for ski boots as defined in claim 2, and said lugs being integrally formed of synthetic material on opposite sides of the ski boot.

* * * * *